United States Patent [19]

Abbott

[11] 4,343,555

[45] Aug. 10, 1982

[54] CHEMICAL PRINT ELEMENT

[75] Inventor: David D. Abbott, Downingtown, Pa.

[73] Assignee: Exxon Research & Engineering Co., Florham Park, N.J.

[21] Appl. No.: 146,684

[22] Filed: May 5, 1980

[51] Int. Cl.[3] ..... B41J 1/30

[52] U.S. Cl. ..... 400/144.2; 400/175; 400/900; 400/904

[58] Field of Search ..... 400/16, 17, 174, 175, 400/144.2, 144.3, 568, 900, 904; 101/399

[56] References Cited

U.S. PATENT DOCUMENTS

| | | | |
|---|---|---|---|
| 3,267,852 | 8/1966 | Gordon | 400/900 X |
| 3,927,752 | 12/1975 | Jones et al. | 400/900 X |
| 3,949,853 | 4/1976 | Lahr et al. | 400/144.3 X |
| 4,037,705 | 7/1977 | Martin et al. | 400/904 X |
| 4,074,798 | 2/1978 | Berger | 400/144.3 |

FOREIGN PATENT DOCUMENTS

| | | | |
|---|---|---|---|
| 627746 | 3/1936 | Fed. Rep. of Germany | 400/900 |

OTHER PUBLICATIONS

*IBM Tech. Disc. Bulletin,* vol. 16, No. 5, Oct. 1973, p. 1515.

*Primary Examiner*—Paul T. Sewell
*Attorney, Agent, or Firm*—Kenneth R. Schaefer

[57] ABSTRACT

Disclosed is a novel print element for a serial impact printer having a novel character set which permits the typing of text as well as chemical symbols and formulae with a small number of character elements. Closed ring structures may be formed with the character set which may be expanded to various sizes. Also disclosed is a serial impact printing system using the aforementioned printing element which automatically subscripts small numerals when the printing element is positioned without further action on the part of the typist.

13 Claims, 4 Drawing Figures

| POS. | CHAR. |
|---|---|
| 1 | / |
| 2 | 1 |
| 3 | g |
| 4 | d |
| 5 | c |
| 6 | l |
| 7 | m |
| 8 | i |
| 9 | r |
| 10 | o |
| 11 | 2 |
| 12 | e |
| 13 | n |
| 14 | t |
| 15 | a |
| 16 | s |
| 17 | h |
| 18 | p |
| 19 | z |
| 20 | x |
| 21 | q |
| 22 | k |
| 23 | j |
| 24 | w |
| 25 | f |
| 26 | v |
| 27 | b |
| 28 | u |
| 29 | y |

| POS. | CHAR. |
|---|---|
| 30 | B |
| 31 | ° |
| 32 | P |
| 33 | S |
| 34 | V |
| 35 | , |
| 36 | M |
| 37 | ] |
| 38 | W |
| 39 | ' |
| 40 | Q |
| 41 | 5 |
| 42 | L |
| 43 | T |
| 44 | A |
| 45 | Y |
| 46 | 6 |
| 47 | F |
| 48 | J |
| 49 | Z |
| 50 | + |
| 51 | D |
| 52 | ? |
| 53 | E |
| 54 | 8 |
| 55 | O |
| 56 | / |
| 57 | C |
| 58 | I |

| POS. | CHAR. |
|---|---|
| 59 | G |
| 60 | ( |
| 61 | H |
| 62 | ) |
| 63 | N |
| 64 | ↓ |
| 65 | R |
| 66 | - |
| 67 | U |
| 68 | ↑ |
| 69 | K |
| 70 | ← |
| 71 | X |
| 72 | → |
| 73 | 4 |
| 74 | [ |
| 75 | = |
| 76 | . |
| 77 | \ |
| 78 | — |
| 79 | I |
| 80 | + |
| 81 | 3 |
| 82 | 2 |
| 83 | 3 |
| 84 | 4 |
| 85 | 9 |
| 86 | 5 |
| 87 | 6 |

| POS. | CHAR. |
|---|---|
| 88 | 7 |
| 89 | 8 |
| 90 | 9 |
| 91 | 7 |
| 92 | \ |

CHEMICAL PRINT ELEMENT

BACKGROUND OF THE INVENTION

The present invention relates in general to a serial impact printer and to a novel print element therefor. In particular, the present invention relates to a serial impact printer and a type element useful therewith for the formation of chemical formulae interspersed with ordinary alphanumeric characters on the same page or document.

The typing of chemical formulae has generally been a rather tedious job. Early prior art general purpose typewriters made no provision for the typing of such formulae. Accordingly, when typing such formulae, the typist was required to insert certain subscripts, superscripts, arrows and symbols by hand, for example with pen and ink. With the development of replaceable print elements, such as typing balls and daisy type printwheels, the aforementioned problem was somewhat alleviated since a general purpose typewriter designed primarily to form alphanumeric characters could be modified by changing print elements to form alphanumerics as well as some chemical symbols, thus allowing the typing of text interspersed with chemical formulae on the same page.

The aforementioned replaceable print elements are limited, however, as to the number and diversity of chemical symbols which can be formed since only a finite number of characters can be placed on a single print element, if at least an upper and lower case alphanumeric character set is to be also provided such that text and chemical symbols may both be formed with the same element. This problem is severe when daisy type printing elements are utilized. In daisy wheel type printing elements, the number of characters is limited by the number of daisy wheel spokes and the number of spokes is limited by the fact that each character requires a minimum size for legibility and therefore the distance between the distal ends of wheel spokes may not be decreased without limit. Further, the distance between distal ends of the spokes may not be increased by substantially increasing the wheel diameter since increasing the diameter increases inertia of the daisy wheel and thus decreases the printing speed. Thus, the provision of a printing element useful in the formation of alphanumeric characters as well as chemical symbols requires some compromise in the ability to form all the characters or symbols which might be desired. In Vydec Chemical Option Reference Manual, 4093—0020, copyright 1979 by Vydec Engineering Publications, a daisy type print element is disclosed having a chemical character set. While the Vydec print element permits the typing of alphanumeric characters interspersed with chemical elements on the same page of text, the Vydec printwheel suffers from certain disadvantages.

First, the Vydec character set employs only a full size number set. Since many chemical formulae require relatively small subscripts and superscripts, as well as full size numerals, it would be desirable to provide a print element for forming alpha-numeric as well as symbols with two full numeral sets, one being full size and the other being half size (hereinafter referred to as upper and lower case numerals respectively) without substantially increasing the number of daisy printing element spokes.

Another disadvantage of the Vydec print wheel is the inability to form closed ring structures of the benzene type of varying size with that wheel because of the inability to form continuous chemical bonds of varying length. It is an object of the present invention to provide a printing element for use in the formation of text as well as chemical formulae which is useful in forming closed ring-like structures and other like structures having varying sizes.

Still another problem associated with prior art impact printers employing chemical printing elements is the requirement that the typist shift the position of the typewriter platen with respect to the print point each time a subscript or superscript is formed. Since the number of subscripts and superscripts formed when typing chemical formulae may be large, the necessity for the typist to shift the relative position of the print element with respect to the platen is tedious thus decreasing typing speed. It would be desirable to provide a serial impact printer with the capability of automatically shifting the relative positions of the print point and platen automatically when subscripts or superscripts are formed.

SUMMARY OF THE INVENTION

These and other objects of the present invention are achieved by the provision of a novel print element for an impact printer useful in the formation of a wide variety of chemical symbols as well as text which employs standard alphanumeric characters and yet which has only a relatively small number of character elements. The foregoing is achieved by the selection of a set of character elements having a number of multi-functional elements included therein. Specifically, a print element is disclosed having a character set including both upper and lower case alphanumerics as well as multifunctional character elements which have typeface configurations of vertical lines, horizontal lines and diagonal lines of varying slope. The horizontal lines and vertical lines are adapted to mate with other character elements having typeface configurations of horizontally and vertically disposed arrows such that arrows of varying length may be formed. In addition, the horizontal line provides the additional function of a character element having the typeface configuration of a minus sign. In one embodiment, the vertical line character element also performs the function of an exclamation point when used in combination with a period. In addition, the dimension and slopes of the character elements having typeface configurations of diagonal lines are chosen such that closed, ringlike structures of varying sizes may be constructed in addition to the formation of a standard slash mark.

In accordance with still another embodiment of the present invention, the aforementioned printing element for a serial impact printer is configured in the shape of a daisy wheel wherein the character elements are situated at the distal ends of spokes radially extending from a central hub. The hub is provided with an encoded area comprising open and closed spaces therein. This printing element is useful in combination with a serial impact printer having a means for moving a copy medium relative to the print element and a sensor means for sensing the presence of a code stored in the coded area on the print element. A keyboard means is provided for selecting particular characters to be applied to the copy medium. A print control means coupled to the sensor and to the keyboard means is provided which controls the movement of the copy medium relative to the print element whenever a lower case numeral has been selected by the keyboard means and the code sensed by the sensor means indicates that the chemical print element of the present invention is situated in the machine. In this manner, a serial impact printer is provided which may automatically subscript lower case numerals without further action on the part of the typist other than selecting those numerals on the keyboard.

RELATED APPLICATIONS

Ser. No. 094,358, filed Nov. 15, 1979, which is assigned to the assignee of the present invention, disclose a coded printing element of which the printing element of the present invention is an improvement. The disclosures of this application are incorporated herein by reference.

BRIEF DESCRIPTION OF THE DRAWINGS

The present invention will be more fully understood by reference to the accompanying drawings in which.

and

Figure 1:
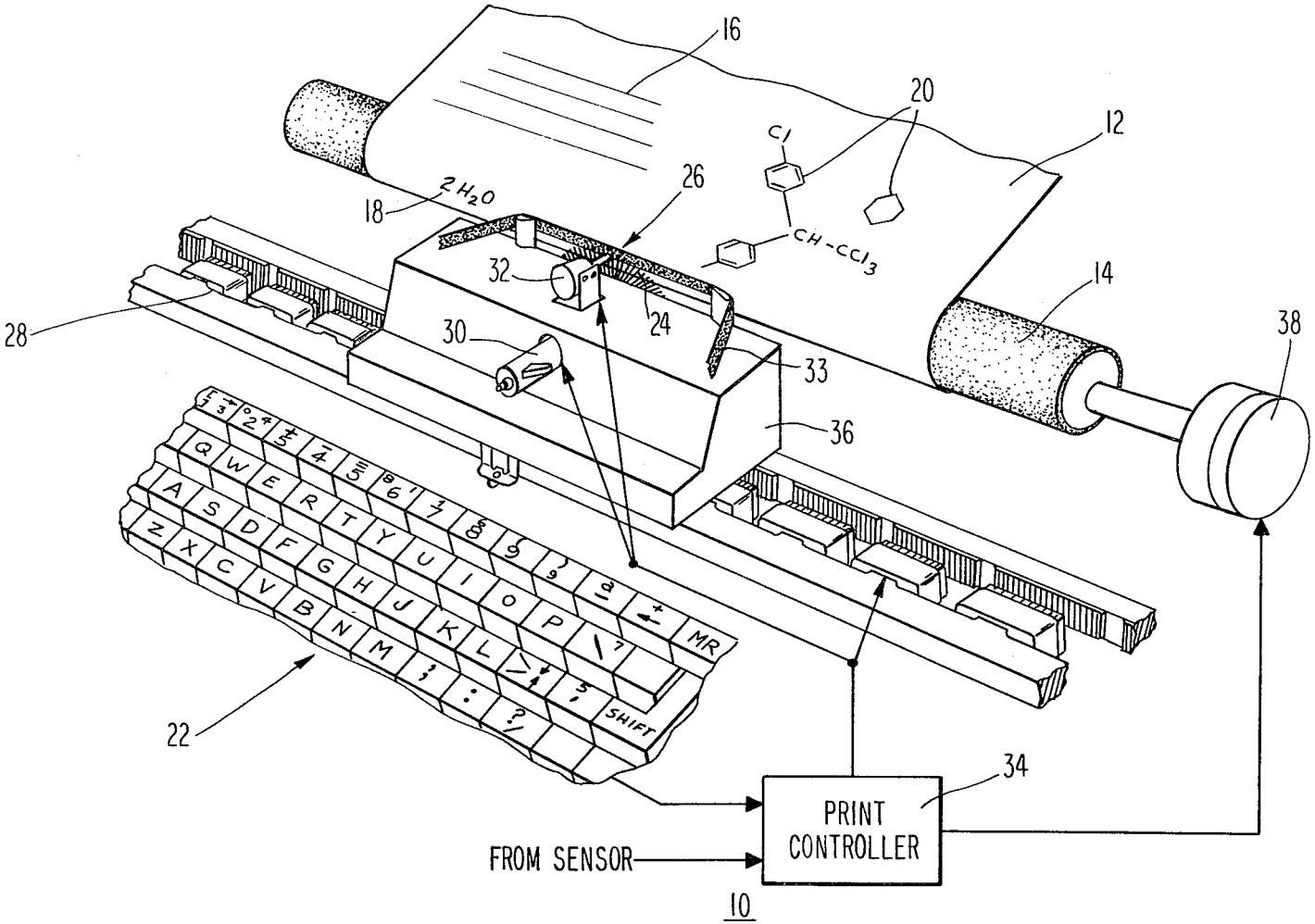
FIG. 1 is a perspective view of a serial impact printing system of the present invention.
Figure 4:
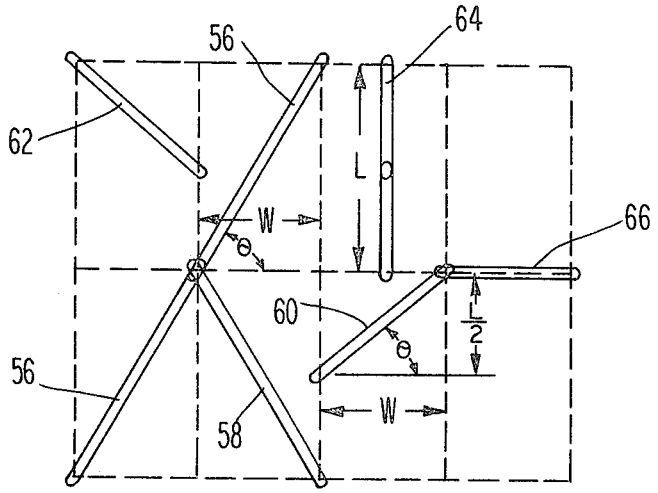
Figure 3:
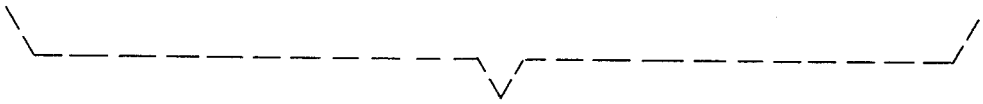
FIG. 3 is a chart of the set of character elements which may be formed with the print element shown in FIG. 2.

FIG. 4 is a diagram on an enlarged scale of the relationship between certain characters formed from the character set of FIG. 3 in the printing system of FIG. 1.

DETAILED DESCRIPTION OF THE PREFERRED EMBODIMENT

Referring now to FIG. 1, a serial impact printing system 10 is generally disclosed. The printing system operates upon a copy medium or document 12 situated upon a rotatable platen 14. The printing system 10 of the present invention is useful in the formation of lines of text 16 upon the document 12 as well as in the formation of chemical formulae 18 and chemical symbols such as the ring structures shown at 20. The particular characters to be formed upon the copy medium 12 are selected from the character set shown on the keyboard means 22. Character elements having the typeface configuration shown on the keyboard means 22 are situated upon a print element 24. In the preferred embodiment of the present invention, the print element 24 comprises the daisy wheel as shown in FIG. 1 which will be more fully described below. The character elements situated upon the print element 24 are adapted to be moved to and from a moveable print position 26 by a plurality of drive means preferably comprising a linear stepper motor 28, a rotary stepper motor 30 and a solenoid driven hammer 32. Each of the drive means 28, 30 and 32 operate under the command of a print control means 34. The linear stepper motor 28, operates to move a carriage 36 in a direction parallel to the axis of the platen 14, so as to move the print position 26 across the width of the copy medium 12. The carriage 36 transports the rotary stepper motor 30 and hammer 32 to the print position 26. At a particular print position 26, the print controller 34 operates to control the rotary stepper motor 30 so as to position the print element 24 such that a selected character element may be situated in the path of the hammer driven by the solenoid 32. The print controller 34 then causes the hammer 32 to cause the character element impact ribbon 33 to form characters upon the copy medium 12.

The printing system 10 shown in FIG. 1 also includes a means 38 for moving the copy medium 12 relative to the print position 26. In accordance with the preferred embodiment of the present invention, the means 38 for moving a copy medium 12 includes a rotary stepper motor which is also under the control of the print controller 34.

In typical prior art printing systems of a general type, the movement of the carriage 36 is in discrete steps across the width of the copy medium 12, the steps having a width W therebetween. The means 38 for moving the copy medium relative to the print position 26 also operates in a stepwise fashion with a length L between the steps. Moreover, the magnitude of the steps, W, taken by the carriage 36 across the width of the copy medium 12 is less than the magnitude of the steps, L, along the length of the copy medium. Because the magnitude of the steps W across the width of the copy medium 12 is less than the magnitude of the steps L along the length of the copy medium, the copy medium 12 is divided into a rectangular grid space, with each space having a width W and length L, the print position 26 being movable about the grid so as to permit the formation of characters within the confines of each space. Means, (not shown) are also provided for selectively moving the carriage 36 in fractional increments of the steps W such as 1/10 or 1/12 W and for selectively moving the copy medium fractional increments of L such as $\frac{1}{4}$ or $\frac{1}{8}$ L as desired.

Figure 2:
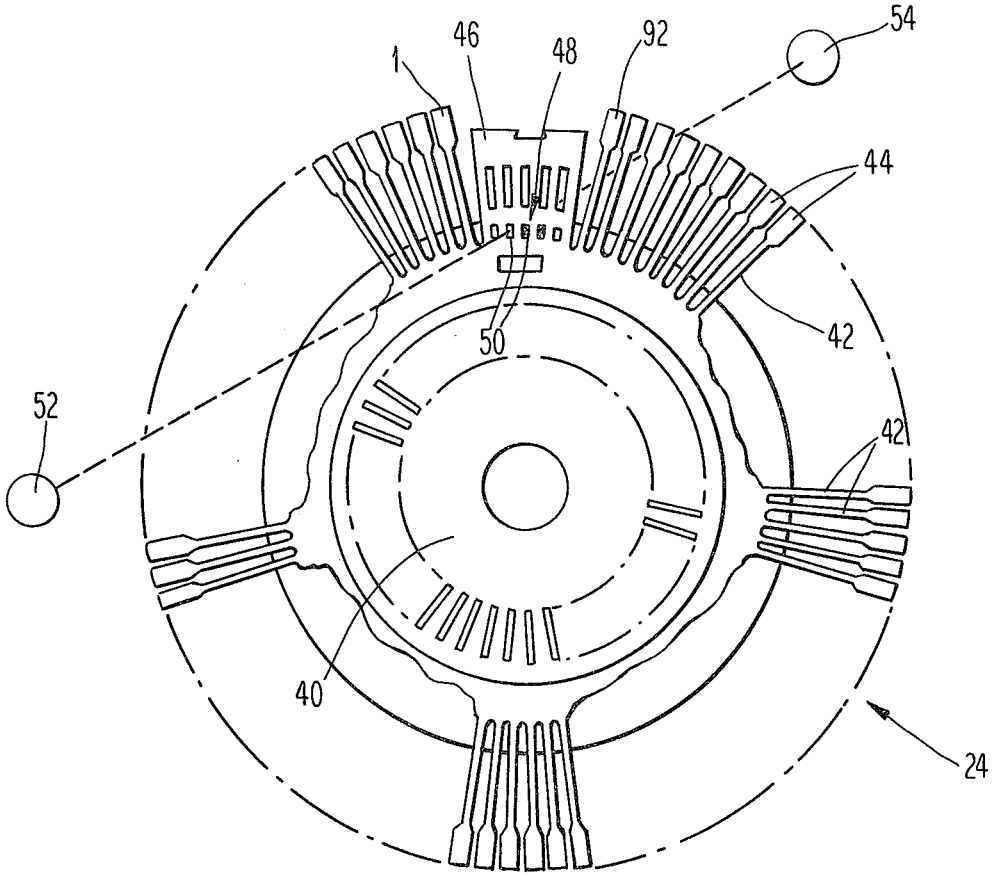
FIG. 2 is a plan view of a print element utilized with the serial impact printing system of FIG. 1.

Referring now to FIG. 2, the print element 24 shown in FIG. 1 will be more fully described. In accordance with the present invention, the print element 24 includes a central hub or support means 40 having radially extending spokes 42 emanating therefrom. At the distal end 44 of the spokes 42 are situated character elements having typeface configurations to be described below. Also provided at the homing position of the print wheel 24 is a handle region 46 having an encoded area 48. In accordance with the teachings of the aforementioned Ser. No. 094,358, filed Nov. 15, 1979, the encoded area 48 includes a plurality of opened and closed spaces 50 which cooperate with a light source 52 in combination with a light sensor means 54. Encoded information stored in the opened and closed spaces 50 and detected by the sensor 54 is directed to the print controller 34. The print controller 34 contains a memory portion (not shown) for storing additional information utilized in the operation of the plurality of drive means 28, 30 and 32.

Referring now to FIG. 3, and in accordance with an important aspect to the present invention, a set of character elements as well as the radial position of those character elements with respect to the print element 24 shown in FIG. 2 will be described. This character set allows for the formation of text, as well as chemical formulae and symbols using a relatively small print element 24. By reference to FIG. 3 it will be seen, that the character element set of the present invention includes a first subset of 52 character elements having the typeface configurations of the upper and lower case English letter alphabet. In the preferred embodiment, this subset of character elements is located at the radial spoke positions shown in FIG. 3.

Also included in the character set shown in FIG. 3 is a second subset consisting of eight character elements having the typeface configuration of numerals from 2–9 and located at radial positions 2, 41, 46, 54, 73, 81, 85 and 91 respectively and a third subset consisting of nine character elements having typeface configurations of numerals from 1–9 and being found at radial positions 2, 82-84, and 86-90. Since the character size of the third subset of character elements is smaller than the character size of the second subset of character elements, the third subset will be referred to as lower case numerals while the second subset will be referred to as upper case numerals. The provision of a character set having subsets including upper and lower case alphanumerics allows for the formation of many chemical formulae as well as textual material. Moreover, in accordance with the present invention, additional character element configurations are included which permit the formation of still other chemical formulae and structures, many of which additional character elements are multi-functional such that the overall number of character elements is not substantially increased. Accordingly, the character elements set shown in FIG. 3 includes a character element having the typeface configuration of a vertical line found at radial position 79 and a character element having the typeface configuration of a horizontal line found at radial position 78. The length of the vertical line may slightly exceed the length L of one grid space and the length of the horizontal line is such that it slightly exceeds the width W of one grid space. Thus these characters may be utilized to form horizontal and vertical lines of varying length. Also included are a first and second pair of character elements having the typeface configurations of oppositely disposed horizontal and vertical arrows found at radial positions 64, 68, 70 and 72. In accordance with the present invention, the vertically disposed arrows are adapted to mate with the vertical line found at position 79 so as to allow for the formulation of vertically disposed arrows of varying length while the horizontally disposed arrows are adapted to mate with the horizontal lines so as to make horizontal arrows of varying length. The character element having a typeface configuration of a horizontal line is multi-functional inasmuch as it may also be utilized for underscoring and as a minus sign useful with upper case numerals. The character element having a typeface configuration of a vertical line in the preferred embodiment is configured so as to have a length slightly greater than one half the longitudinal dimension L of the aforementioned grid space. In this manner, the character element may be utilized in combination with the period found at radial position 76 for the formation of an exclamation point or utilized twice in the same grid space to form a continuous vertical line.

Also included in the character set shown in FIG. 3 and in accordance with an important aspect of the present invention are a third and fourth pair of character elements having the typeface configurations of diagonal lines of differing slopes which are useful in the formation of ring-like structures 20 shown in FIG. 1. In accordance with another important aspect of the invention to be more fully explained below, the slopes and dimensions of these diagonal lines may be appropriately selected so as to permit the typing of not only closed but also expandable ring-like structures and also to form a delta symbol.

In addition to the character elements previously referred to, the typing of textual material requires the presence of character elements having typeface configurations of oppositely disposed parentheses, brackets, as well as various punction marks. Moreover, plus signs useful with both upper and lower case numerals as well as an equal sign are provided.

Referring now to FIG. 4, an example of the slopes and dimensions of the aforementioned diagonal character elements will be described. FIG. 4 shows eight spaces of the aforementioned rectangular grid space, each space having a length L and a width W. In the preferred embodiment, L is equal to 1/6th of an inch and W is equal to 1/10th of an inch. Shown in FIG. 4 is a character 56 formed by the character element located at radial position 56. The character 56 has a slope of L/W and a dimension slightly exceeding L/sin $\theta$, where $\theta$ is an angle whose tangent is L/W. This length permits the character 56 to extend slightly into an adjoining space of the rectangular grid so as to connect with a similar character located there in forming an extended line. Also shown is a character 58 formed with the character element at radial position 77 and having a slope of minus L/W and with the same dimension as character 56. Also shown in FIG. 4 is a character 60 formed with the character element found at radial position 1 and having a slope of L/2W and a dimension of L/2 sin $\theta$ where $\theta$ is an angle whose tangent is L/2W. A character 62 is shown which is formed by the character element found at radial position 92 and having a slope of minus L/2W with the same dimension as the character 60. Also shown in FIG. 4 are horizontal and vertical characters 64 and 66. Because of the aforementioned slopes and dimensions characters 55–64 formed with character elements at positions 56, 77, 1, 92, 78 and 79 respectively may be utilized to form ring structures of varying sizes such as the following:

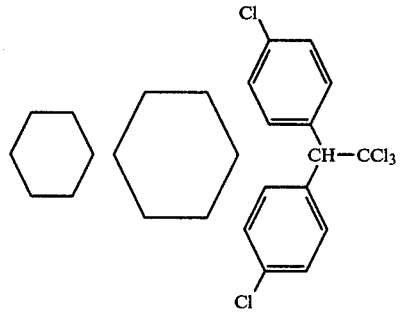

In accordance with still another important aspect of the present invention, the code defined by the opened and closed spaces 50 on the print element 24 is such as to uniquely identify a print element as having the character set shown in FIG. 3. When that code is sensed by the sensor means 54 and communicated to the print controller 34, additional information stored in the memory portion of the print controller 34 is utilized to control the increment and movement of the copy medium 12 with respect to the print element 24. In accordance with this aspect of the invention, whenever the code identifying the character set of the present invention has been sensed by the sensor means 54 and character elements from the subset of lower case numerals have been selected by the keyboard means 22, the means 38 for moving the copy medium 12 advances the copy medium relative to the print element such that the aforementioned lower case numerals are automatically subscripted without further action on the part of typist. After the lower case numerals have been imprinted upon the copy medium 12 and the character element has been removed from the print position, the means 38 for moving the copy medium is caused to retreat to its original position by the print controller 34.

While particular embodiments of the present invention have been shown and described, various modifications may be made without departing from the spirit and scope of the invention or the scope of the appended claims.

What is claimed is:

1. A print element for a serial impact printer for forming characters within a rectangular grid space having a length L and a width W on a document comprising:

a first set consisting of 52 character elements having the typeface configurations of the upper and lower case English language alphabet;

a second set consisting of 8 character elements having typeface configurations of upper case numerals from 2 through 9;

a third set consisting of 9 character elements having typeface configurations of the lower case numerals from 1 through 9;

a character element having a typeface configuration of a vertical line;

a character element having a typeface configuration of a horizontal line;

a first pair of character elements each having a typeface configuration of a horizontally disposed arrow, each arrow being oppositely disposed to the other and adapted to mate with said horizontal line;

a second pair of character elements each having a typeface configuration of a vertically disposed arrow, each arrow being oppositely disposed to the other and adapted to mate with said vertical line;

a third pair of character elements each having a typeface configuration of a diagonal line with slopes of plus and minus L/W respectively;

the character elements of said third pair each having a length slightly exceeding $L/\sin\theta$, where $\theta$ equals arctan L/W, each passing through at least one corner of said grid space and extending to a diagonally opposite corner of said grid space; and a fourth pair of character elements each having a typeface configuration of a diagonal line with slope of plus and minus L/2W respectively;

the character elements of said fourth pair each having a length slightly exceeding $L/2 \sin\theta'$, where $\theta'$ equals arctan L/2w, each passing through at least one corner of said grid space and extending to an opposite side of said grid space substantially at a mid-point of said opposite side;

each of said character elements situated at the distant end of a separate spoke radially extending from a central hub.

2. The print element of claim 1 further comprising:

a fifth pair of character elements each having a typeface configuration of a parenthesis, the parentheses being oppositely disposed to one another.

3. The print element of claim 2 further comprising:

a sixth pair of character elements each having a typeface configuration of a bracket, said brackets being oppositely disposed to one another.

4. The print element of claim 3 further comprising:

a seventh pair of character elements each having a typeface configuration of a plus sign, one being upper case and one being lower case.

5. The print element of claim 4 further comprising:

a fourth set of six character elements having typeface configurations consisting of a question mark, a period, a comma, an apostrophe, a minus sign and an equal sign.

6. The print element of claim 5 wherein said hub includes an encoded area.

7. The print element of claim 6 wherein said encoded area comprises a plurality of open and closed spaces arranged in an arcuate pattern concentric with said hub.

8. The print element of claim 1 wherein said vertical line has a dimension slightly exceeding the length of said grid space.

9. The print element of claim 1 wherein said vertical line has a dimension slightly exceeding one half the length of said grid space.

10. The print element of claim 1 wherein said horizontal line has a dimension slightly exceeding the width of said grid space.

11. The print element of claim 1 wherein said horizontal line has a dimension slightly less than the length of said grid space.

12. The print element of claim 1 where L equals 1/6 inch and W equals 1/10 inch.

13. A serial impact printing systems comprising:

a print element having support means;

a set of character elements mounted on said support means in a character array, each of said character elements in said array adapted to be moved to and from a print position, said set including a subset having typeface configuration of lower case numerals;

at least one coded area mounted on said support means containing a code for identifying said print element;

drive means coupled to said print element for moving said character elements to and from said print position;

means for moving a copy medium lengthwise relative to said print element;

keyboard means for selecting particular ones of said set of print characters to be moved to said copy medium;

sensor means for sensing the coded area of said print element; and print control means responsive to said sensor means and to said keyboard means and coupled to said moving means for controlling the lengthwise increment and movement of said copy medium relative to said print element whenever said code has been sensed by said sensor means and print characters from said subset have been selected by said keyboard means;

said means for moving said copy medium moving said medium lengthwise in discrete steps of a first magnitude corresponding to a line to line step and, when a character from said second subset has been selected, for moving said medium first in one direction in a step of a second magnitude less than said first to permit imprinting of said selected character of said subset in a position displaced lengthwise of said medium from adjacent imprinted characters and then returning said copy medium to its previous lengthwise position when said character element of said subset is moved away from said print position.

* * * * *